US007249587B2

(12) United States Patent
Matsuda

(10) Patent No.: US 7,249,587 B2
(45) Date of Patent: Jul. 31, 2007

(54) AIR-INTAKE DEVICE OF ENGINE FOR LEISURE VEHICLE AND ENGINE

(75) Inventor: Yoshimoto Matsuda, Kobe (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 125 days.

(21) Appl. No.: 11/084,839

(22) Filed: Mar. 18, 2005

(65) Prior Publication Data

US 2005/0211221 A1 Sep. 29, 2005

(30) Foreign Application Priority Data

Mar. 24, 2004 (JP) ..... 2004-087118

(51) Int. Cl.
*F02D 9/08* (2006.01)
*F02M 35/108* (2006.01)
*F02D 9/02* (2006.01)
*F02M 35/104* (2006.01)

(52) U.S. Cl. ..... 123/337; 123/432

(58) Field of Classification Search ..... 123/337, 123/432

See application file for complete search history.

(56) References Cited

U.S. PATENT DOCUMENTS 4,702,207 A * 10/1987 Hatamura et al. ..... 123/302
5,203,299 A * 4/1993 Ueka ..... 123/308
5,636,613 A * 6/1997 Aoyama et al. ..... 123/432
5,640,941 A * 6/1997 Hazen et al. ..... 123/306
5,651,344 A * 7/1997 Nishigaki et al. ..... 123/432
5,720,255 A * 2/1998 Yoshikawa ..... 123/337
5,799,638 A * 9/1998 Tsuchida et al. ..... 123/302
5,806,484 A * 9/1998 Yoneyama et al. ..... 123/308
5,852,994 A * 12/1998 Tsuzuku et al. ..... 123/308
6,155,229 A * 12/2000 Cantrell et al. ..... 123/336
6,394,066 B1 * 5/2002 Chou et al. ..... 123/308
6,769,397 B2 * 8/2004 Katou et al. ..... 123/337
6,782,872 B2 * 8/2004 Moschini et al. ..... 123/470

FOREIGN PATENT DOCUMENTS

JP 2000-204953 7/2000

* cited by examiner

*Primary Examiner*—Tony M. Argenbright
*Assistant Examiner*—Arnold Castro
(74) *Attorney, Agent, or Firm*—Alleman Hall McCoy Russell & Tuttle LLP

(57) ABSTRACT

An air-intake device of an engine for a leisure vehicle, in which at least two air-intake passages are arranged within an engine body of the engine, is disclosed, including an air-intake pipe through which fresh air is supplied to the at least two air-intake passages arranged within the engine body, and a throttle valve openably mounted within a passage of the air-intake pipe. Typically, the air-intake pipe is structured such that the passage has a cross-section of a non-perfect circle shape and an outer periphery of the air-intake pipe has a cross-section of a circle shape with a continuously varying positive curvature. Typically, the throttle valve has a valve disc of a non-perfect circle shape conforming to the shape of the cross-section of the passage of the air-intake pipe.

11 Claims, 10 Drawing Sheets

AIR-INTAKE DEVICE OF ENGINE FOR LEISURE VEHICLE AND ENGINE

BACKGROUND OF THE INVENTION

1. Field of the Invention

The present invention relates to an air-intake device having an air-intake pipe connected to an air-intake passage formed in an engine body of an engine for leisure vehicles such as motorcycles, three-wheeled vehicles, all terrain vehicles, or personal watercraft (PWC), and an engine for a leisure vehicle equipped with the air-intake device.

2. Description of the Related Art

In one type of an engine mounted in leisure vehicles such as motorcycles, three-wheeled vehicles, all terrain vehicles, or personal watercraft (PWC), at least two-air-intake passages are arranged within a cylinder head, and an air-fuel mixture (fresh air containing a fuel) is guided from the air-intake passages to a combustion chamber through air-intake valves. More specifically, the engine is provided with at least two air-intake valves per cylinder and is configured such that the air-fuel mixture is supplied from the two air-intake passages arranged within the cylinder head to the combustion chamber through these air-intake valves. In such an engine, the air-fuel mixture is drawn to the respective air-intake passages of the cylinder head through an air-intake device having a common air-intake pipe within which a throttle valve is mounted (see Japanese Laid-Open Patent Application Publication No. 2000-204953).

Typically, a connecting portion of the air-intake passages which are connected to the air-intake pipe has a cross-section of substantially an elongated circle shape to allow the two air-intake passages to form a single air-intake passage, while the air-intake pipe has a cross-section of substantially a perfect circle shape in view of the relationship with a throttle valve openably (or pivotally) mounted within the air-intake pipe. The air-intake passage and the air-intake pipe, the cross-sectional shapes of which differ from each other, are connected to each other through a connecting member called a "holder" (or insulator), or the like. Specifically, one end portion of the conventional holder has a cross-section of substantially an elongated circle shape to conform to that of the air-intake passage, and an opposite end portion thereof has a cross-section of substantially a perfect circle shape conforming to that of the air-intake pipe. In addition, an intermediate portion of the holder has a cross-section which gradually changes its shape from the substantially elongated circle shape to the substantially perfect circle shape.

While the fresh air is flowing through the holder, the air flow is disturbed due to a fluctuation in a pressure loss in the passage of the intermediate portion in which the cross-section gradually changes its shape from the substantially elongated circle shape to the substantially perfect circle shape. As a result, air-intake efficiency decreases.

SUMMARY OF THE INVENTION

The present invention addresses the above described condition, and an object thereof is to provide an air-intake device which is easily mounted to an air-intake passage within an engine body of an engine for a leisure vehicle and is capable of improving air-intake efficiency of the engine, and an engine for a leisure vehicle which is equipped with the air-intake device.

According to one aspect of the present invention, there is provided an air-intake device of an engine for a leisure vehicle, in which at least two air-intake passages are arranged within an engine body of the engine, comprising an air-intake pipe through which fresh air is supplied to the at least two air-intake passages arranged within the engine body; and a throttle valve openably mounted within a passage of the air-intake pipe; wherein the air-intake pipe is structured such that the passage has a cross-section of a non-perfect circle shape and an outer periphery of the air-intake pipe has a cross-section of a circle shape with a continuously varying positive curvature; and wherein the throttle valve has a valve disc of a non-perfect circle shape conforming to the shape of the cross-section of the passage of the air-intake pipe.

In accordance with the air-intake device constructed above, the cross-sectional shape does not substantially change from the passage formed within the air-intake pipe within which the throttle valve is mounted to the air-intake passage formed within the engine body, a fluctuation in a pressure loss does not substantially occur in the passage within which an air-fuel mixture flows, and therefore, the air flow in this passage is not substantially disturbed. In such an engine, air-intake efficiency increases.

The air-intake device of the present invention is easily connected to the air-intake passage formed within the engine body of the engine for a leisure vehicle, and increases air-intake efficiency.

Since the passage of the air-intake pipe of the air-intake device has the cross-section of the non-perfect circle shape, the passage of the air-intake pipe is oriented in such a manner that the direction in which the dimension of the passage is small corresponds with the direction in which the dimension of the space is small. Therefore, the air-intake pipe can be compactly configured in a relatively limited space.

The air-intake device may further comprise a fuel injection nozzle mounted to the air-intake pipe such that an injection port formed at a tip end of the fuel injection nozzle opens in the passage of the air-intake pipe, and the fuel injection nozzle may be mounted in a mounting hole formed on the air-intake pipe such that the injection port retreats radially outward from an inner wall of the air-intake pipe. Since the fuel injection nozzle thus positioned does not disturb the air flow within the air-intake pipe, higher air-intake efficiency is gained.

The mounting hole may be tapered to have a diameter which increases toward an inside of the air-intake pipe, and an angle of the tapered mounting hole may be configured to be larger than a spray divergence angle at which a fuel is injected to an inside of the passage of the air-intake pipe through the fuel injection port. In this structure, the fuel can be injected to the air flow efficiently without disturbing the air flow and without being interrupted by the wall of the mounting hole.

The non-perfect circle shape may be substantially an elongated circle shape having long and short axes. Since the elongated circle is formed by a part of perfectly circular portion and straight portion, the throttle valve or the like is easy to manufacture. In addition, a clearance between the throttle valve and the inner wall of the passage of the air-intake pipe can be minimized. This is because, the straight portion of the elongated circle shape, if displaced in the longitudinal direction thereof, does not substantially affect the clearance between the straight portion and the inner wall of the passage of air-intake pipe, and hence the throttle valve can be disposed within the air-intake pipe with less clearance. Further, the non-perfect circle shape may be substantially an oval shape having long and short axes.

According to another aspect of the present invention, there is provided an air-intake device of an engine for a leisure vehicle, in which at least two air-intake passages are arranged within an engine body of the engine, comprising an air-intake pipe through which fresh air is supplied to the at least two air-intake passages arranged within the engine body; and a throttle valve openably mounted within a passage of the air-intake pipe; wherein the passage of the air-intake pipe is configured to have a cross-section of a non-perfect circle shape; and wherein the throttle valve has a valve disc of a non-perfect circle shape conforming to the shape of the cross-section of the passage of the air-intake pipe and a pivot formed integrally on both sides of the valve disc, and the valve disc is pivotable around the pivot to open and close the throttle valve.

In accordance with the air-intake device constructed above, the cross-sectional shape does not substantially change from the passage of the air-intake pipe within which the throttle valve is mounted to the air-intake passage formed within the engine body, a fluctuation in a pressure loss does not substantially occur in the passage within which an air-fuel mixture flows, and therefore, the air flow in this passage is not substantially disturbed. As a result, air-intake efficiency of the engine increases.

Since the passage of the air-intake pipe of the air-intake device has the cross-section of the non-perfect circle shape, the passage of the air-intake pipe is oriented in such a manner that the direction in which the dimension of the passage is small corresponds with the direction in which the dimension of the space is small. Therefore, the air-intake pipe can be compactly configured in a relatively limited space. Further, the throttle valve may be structured such that the pivot is formed integrally with both ends of the valve disc. Thereby, the air flow is not substantially disturbed by the throttle valve. As a result, air-intake efficiency of the engine further increases.

The air-intake pipe within which the throttle valve is mounted may be divided into at least two parts. In such a structure, the valve disc and the pivot of the throttle valve, which are integral with each other, can be mounted within the air-intake pipe.

The air-intake pipe may be divided into the at least two parts at a position of an axis of the pivot of the throttle valve to form an upstream portion and a downstream portion in air flow (in the direction substantially perpendicular to the longitudinal direction of the passage of the air-intake pipe). In such a structure, also, the valve disc and the pivot of the throttle valve, which are integral with each other, can be mounted within the air-intake pipe.

The air-intake pipe may be divided into the at least two parts at a position of an axis of the pivot of the throttle valve in a longitudinal direction of the air-intake pipe. Since a parting face of a casting mold becomes simpler, the air-intake pipe can be easily manufactured.

The pivot of the throttle valve may be positioned at a connecting face at which the air-intake pipe is connected to the air-intake passage. Such a structure is desirably simple, because a mounting portion by which the pivot is mounted to the connecting face exists at separate components, i.e., to the connecting face between a throttle body (or air-intake manifold) in which the air-intake pipe exists and the engine body within which the air-intake passages are arranged.

The non-perfect circle shape may be substantially an elongated circle shape having long and short axes. Since the elongated circle is formed by a part having a perfectly circular portion and a straight portion, the throttle valve or the like is easy to manufacture. In addition, a clearance between the throttle valve and inner the wall of the passage of the air-intake pipe can be minimized. This is because the straight portion, if displaced in the longitudinal direction thereof, does not substantially affect the clearance between the straight portion and the inner wall of the passage of the air-intake pipe, and hence the throttle valve can be disposed within the air-intake pipe with less clearance. Further, the non-perfect circle shape may be substantially an oval shape having long and short axes.

The air-intake pipe may be tapered to have a passage with a cross-section that gradually decreases toward the air-intake passage. In addition, a taper angle $\alpha$ of a wall of the air-intake pipe that is formed when sectioned along the long axis, may be configured to be smaller than a taper angle $\beta$ of a wall of the air-intake pipe that is formed when sectioned along the short axis. Thereby, a desired cross-sectional area of the air-intake pipe can be obtained even when a clearance between adjacent cylinders in the longitudinal direction is small.

The air-intake pipe may be tapered to have a passage with a cross-section which gradually decreases toward the air-intake passage, and a taper angle with a first constant angle may be formed from a downstream end of the air-intake pipe in an air flow to the valve disc and a taper angle with a second constant angle may be formed from the valve disc to an upstream end of the air-intake pipe. Thereby, the air-intake pipe and the throttle valve can be easily manufactured (or molded). In addition, desirably, the air flow in this portion is not substantially disturbed.

A flange portion may be formed on one side of the pivot which is adjacent to the valve disc so as to be in contact with a side surface of a bearing in a longitudinal direction thereof. The flange portion facilitates positioning of the valve disc in the axial direction of the pivot, and the pivot and the bearing are tightly sealed.

A seal member may be externally fitted to an outer end portion of a bearing by which the pivot is mounted to the air-intake pipe. The seal member enhances sealing effect.

The air-intake device may further comprise a fuel injection nozzle mounted to the air-intake pipe such that an injection port formed at a tip end of the fuel injection nozzle opens in the passage of the air-intake pipe; and the fuel injection nozzle may be mounted in a mounting hole formed on the air-intake pipe such that the injection port retreats radially outward from an inner wall of the air-intake pipe. Since the fuel injection nozzle thus positioned does not disturb the air flow within the passage of the air-intake pipe, air-intake efficiency increases.

The mounting hole may be tapered to have a diameter which increases toward an inside of the air-intake pipe, and an angle of the tapered mounting hole may be configured to be larger than a spray divergence angle at which a fuel is injected to an inside of the passage of the air-intake pipe through the fuel injection port. In this structure, the fuel can be injected to the air flow efficiently without disturbing the air flow and without being interrupted by the wall of the mounting hole.

According to a further aspect of the present invention, there is provided an engine for a leisure vehicle comprising the above described air-intake device.

In accordance with the engine for the leisure vehicle constructed above, the air-intake device can be compactly configured in a limited space and increase air-intake efficiency.

The above and further objects and features of the invention will more fully be apparent from the following detailed description with accompanying drawings.

DETAILED DESCRIPTION OF THE PREFERRED EMBODIMENTS

Hereinafter, embodiments of an air-intake device and an engine for a leisure vehicle equipped with the air-intake device according to the present invention will be described with reference to the accompanying drawings.

Figure 1:
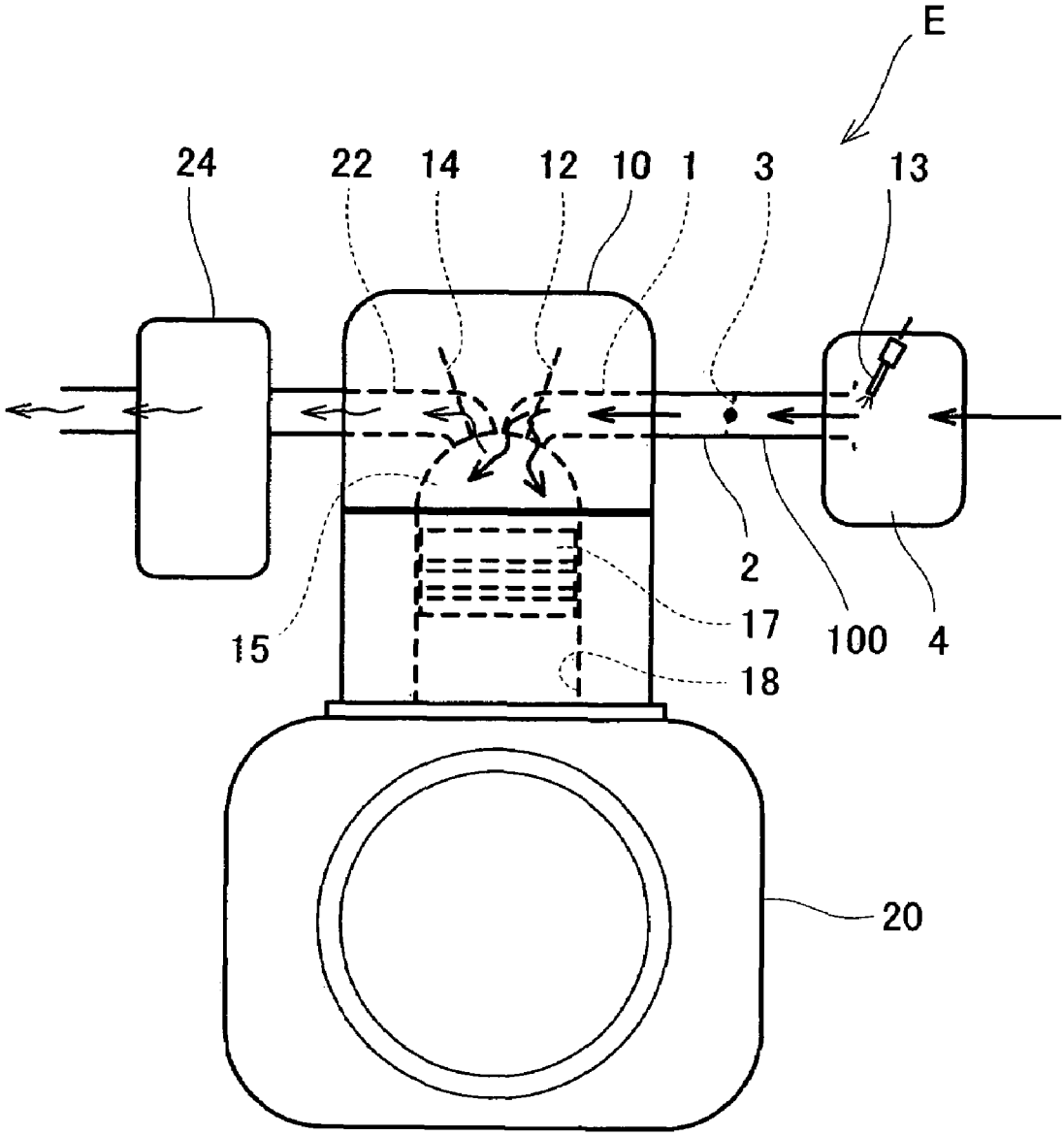
FIG. 1 is a view schematically showing a construction of an entire engine for a leisure vehicle which is equipped with an air-intake device according to an embodiment of the present invention.

Referring now to FIG. 1, a reciprocal four-cycle engine E according to the embodiment has a cylinder head (engine body) 10 provided with an air-intake passage 1 and is configured to supply an air-fuel mixture to a combustion chamber 15 through air-intake valves 12. The engine E of this embodiment is a four-valve engine provided with two air-intake valves 12 and two exhaust valves 14 per cylinder. A downstream end of an air-intake pipe (generally called "air-intake manifold" or "throttle body") 2 of an air-intake device 100 is connected to an upstream end of the air-intake passages 1. As used herein, "upstream" and "downstream" are meant to define the direction of air-intake flow in the engine E. A throttle valve 3 is mounted within a passage 2*p* of the air-intake pipe 2 to be pivotable within a predetermined angle range. At least an upstream end portion of the air-intake pipe 2 (entire upstream end portion of the air-intake pipe 2 in this embodiment) protrudes into an air-intake box (also referred to as an air box) 4. Fresh air is supplied from the air-intake box 4 to the passage 2*p* of the air-intake pipe 2. The upstream end portion of the air-intake pipe 2 which protrudes into the air-intake box 4 is flared (funnel-shaped) such that its width gradually increases toward the upstream end to improve air-intake efficiency. A fuel injection nozzle 13 is provided upstream of the air-intake pipe 2 such that a base end thereof is connected to a fuel injection pump (not shown). The fuel is injected from the air injection nozzle 13 to fresh air at suitable timings. The fuel injection nozzle 13 is positioned on a short axis or a long axis of the cross-section of the passage 2*p* of the air-intake pipe 2 or is slightly displaced from the short axis or the long axis. In FIG. 1, reference designator 17 denotes a piston disposed in a cylinder 18, reference designator 20 denotes a crankcase, reference designator 22 denotes an exhaust passage, and reference designator 24 denotes an exhaust muffler. Although not shown in FIG. 1, ignition plugs are disposed between the two air-intake valves 12 and between the two exhaust valves 14.

Figure 2:
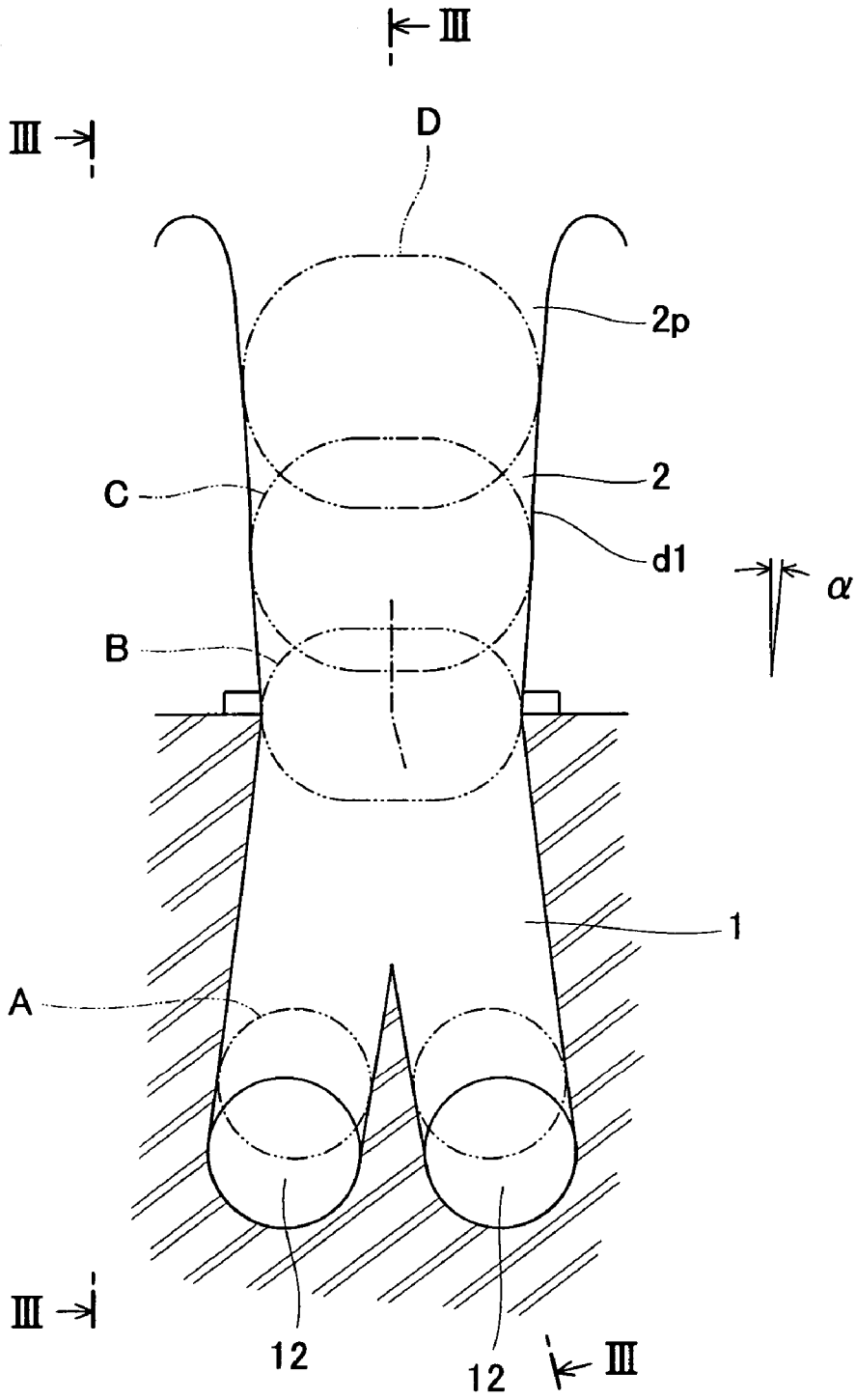
FIG. 2 is a view schematically showing cross-sectional shapes of main parts of an air-intake passage and an air-intake pipe of the air-intake device of the engine of FIG. 1.

As shown in FIG. 2, the air-intake passage 1 is provided with two air-intake ports at downstream end portions thereof. The air-intake passage 1 braches into the downstream end portions to correspond to the two air-intake valves 12. The upstream end portion of the air-intake passage 1, which is connected to a downstream end portion of the air-intake pipe 2, forms a single passage having a cross section of substantially an elongated circle shape having long and short axes (see a cross-sectional shape B indicated by two-dotted line of FIG. 2). The shape of the cross-sections of the downstream end portions corresponding to the air-intake ports and downstream portions extending from the branch position of the air-intake passage 1 substantially conforms to the shape of the air-intake valves 12, which may be for example, a substantially perfect circle shape, as shown in this embodiment (see cross-sectional shape A indicated by two-dotted line of FIG. 2).

Figure 3:
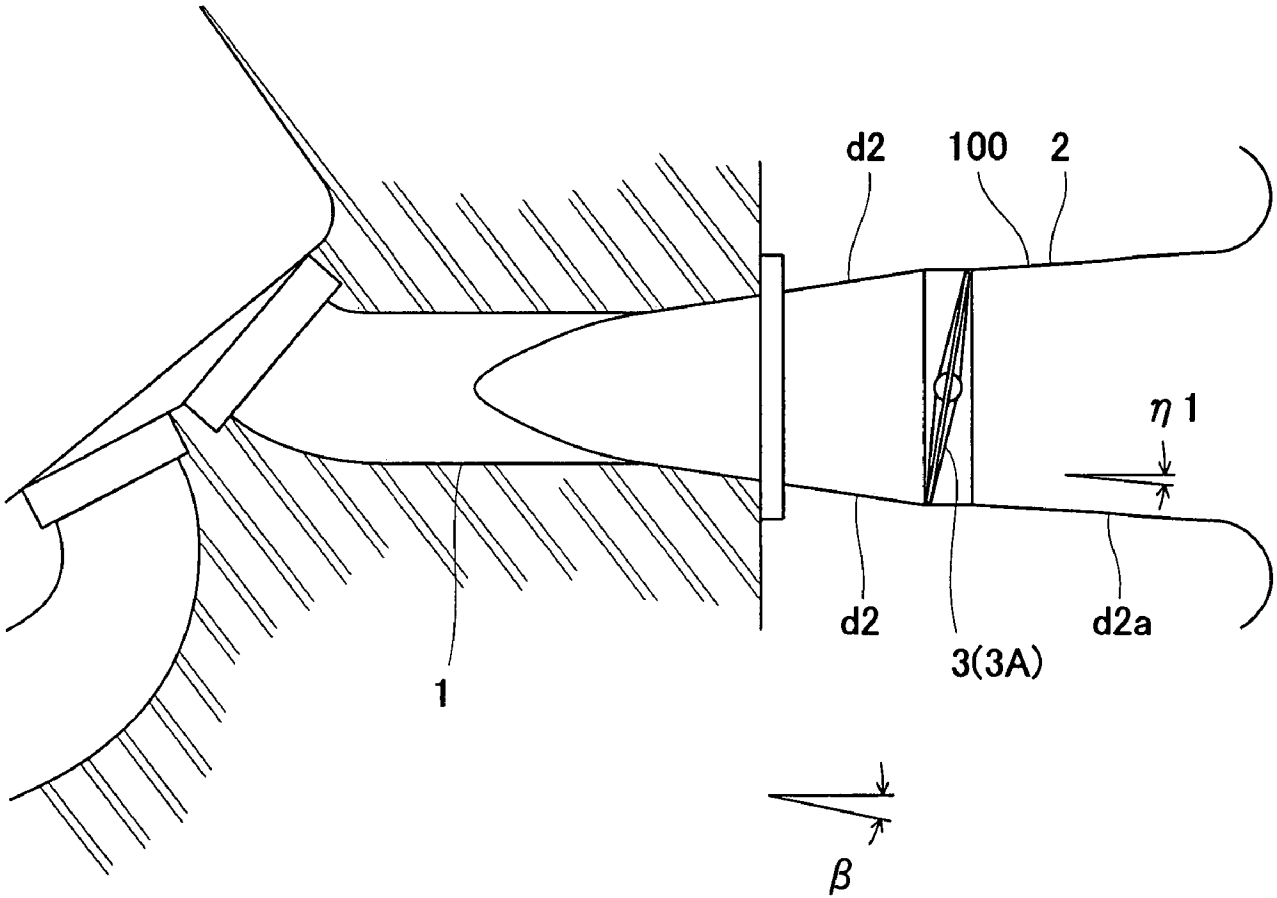
FIG. 3 is a view taken in the direction of arrows substantially along line III-III of FIG. 2, schematically showing a structure of the air-intake passage, the air-intake pipe of the air-intake device, and a throttle valve of the engine.

In this embodiment, the passage 2*p* of the air-intake pipe 2 is tapered to have a cross-sectional area which gradually decreases from the upstream end thereof toward the downstream end thereof. As shown in FIG. 3, the passage 2*p* of the air-intake pipe 2 is structured such that a wall d2 of the air-intake pipe 2 which is formed when sectioned along the short axis of the elongated circle shape has a portion d2*a* located upstream of the throttle valve 3 and formed to have a constant taper angle $\eta 1$ and a portion d2*b* located downstream of the throttle valve 3 and formed to have a constant taper angle $\beta$ ($\eta 1<\beta$). In this embodiment, a taper angle $\alpha$ of a wall (see "d1" of FIG. 2) of the air-intake pipe 2 which is formed when sectioned along the long axis of the elongated circle shape is smaller than the taper angle β of the wall (see "d2*b*" of FIG. 3) of the air-intake pipe 2 which is formed when sectioned along the short axis of the elongated circle shape and located downstream of the throttle valve 3.

The downstream end portion of the passage 2*p* of the air-intake pipe 2 has a cross section of substantially an elongated circle shape having long and short axes, which is substantially identical to the shape of the cross-section of the upstream end portion of the air-intake passage 1 (see the cross-sectional shape B indicated by two-dotted line of FIG. 2). In this embodiment, the passage 2*p* of the air-intake pipe 2 has a cross-sectional area which gradually increases toward the upstream end thereof (see cross-sectional shapes C and D on the upstream side of the air-intake pipe 2 of FIG. 2). In brief, the entire passage 2*p* of the air-intake pipe 2 has a cross-sectional shape of substantially the elongated circle shape having long and short axes.

Figure 4:
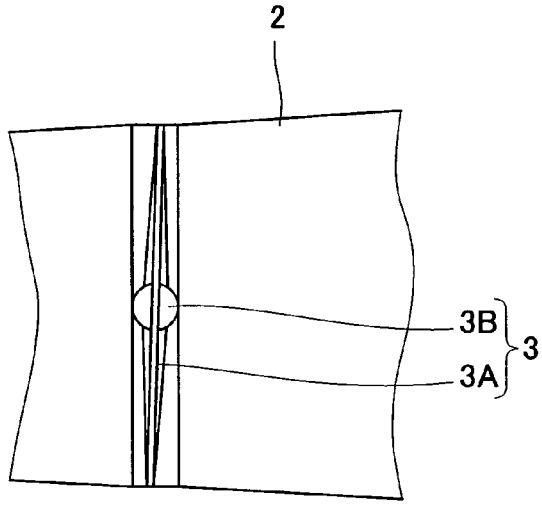
FIG. 4 is a partially enlarged cross-sectional view of FIG. 3, showing a structure of the throttle valve and the air-intake pipe.

The throttle valve 3 is openably (pivotally) mounted within the passage 2*p* of the air-intake pipe 2. The throttle valve 3, to be precise, a valve disc 3A (see FIG. 5 or FIG. 7) has a cross-section of substantially an elongated circle shape having long and short axes to substantially close the passage 2*p* of the air-intake pipe 2. As shown in FIG. 4, the throttle valve 3 (valve disc 3A) is sized to be slightly smaller than the passage 2*p* of the air-intake pipe 2 by, for example, approximately 0.05 mm to 0.20 mm, to smoothly open and close the passage 2*p* of the air-intake pipe 2. As shown in FIG. 8B, an end portion 3*a* of the throttle valve 3 is cut to form an end face 3*f*, which is spaced apart from the wall (inner wall) of the passage 2*p* of the air-intake pipe 2 to extend in parallel with the wall of the passage 2*p* with the throttle valve 3 fully closed. The ratio of the short axis to the long axis of the elongated circle shape of the passage 2*p* of the air-intake pipe 2 and the throttle valve 3 is desirably set to approximately ⅗ to ⅘.

In the engine constructed above, since the cross-sectional shape does not substantially change from the passage 2*p* of the air-intake pipe 2 to a portion of the air-intake passage 1 which is located upstream of the branch position of the air-intake passage 1 within the engine body, the air-fuel mixture is flowing in this portion without substantial fluctuation in a pressure loss. Therefore, the air flow of the air-fuel mixture is not substantially disturbed when the air-fuel mixture is supplied to the air-intake ports within the cylinder head 10. As a result, air-intake efficiency of the engine E increases.

The exhaust passages 22 may be configured in the same manner to improve air-exhaust efficiency of the engine E, although not shown.

Figure 7:
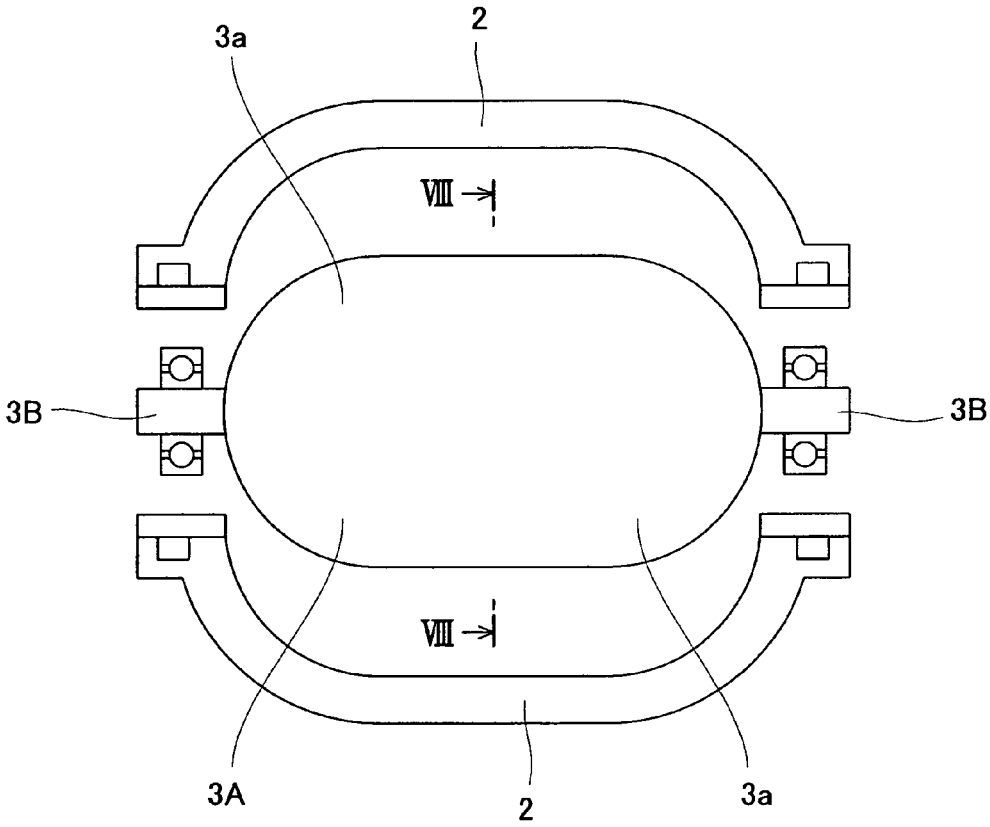
FIG. 7 is a view showing a structure of the throttle valve having the valve disc of a substantially elongated circle shape similar to that of FIG. 5 and a pivot, and the air-intake pipe (composed of two divided parts) within which the throttle valve is mounted, as viewed from the longitudinal direction of the air-intake pipe.
Figure 8A:
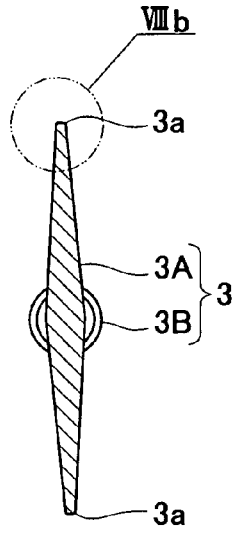
FIG. 8A is a view taken in the direction of arrows substantially along line IIIV-IIIV of FIG. 7, showing a cross-sectional shape of the throttle valve of FIG. 7.
Figure 8B:
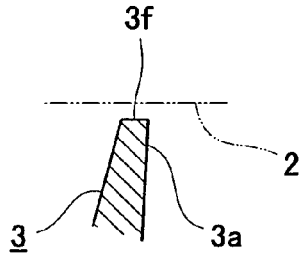
FIG. 8B is a partially enlarged view of an end portion (circular portion indicated by two-dotted line VIIb of FIG. 8A) of the valve disc of the throttle valve of FIG. 8A.

As shown in FIGS. 7 and 8, in the engine E constructed above, the throttle valve 3 may alternatively be structured such that a pivot 3B around which the valve disc 3A is pivotable protrudes integrally and laterally from both ends of the valve disc 3A, i.e., the pivot 3B is not contained in the valve disc 3A. In the throttle valve 3 thus structured, the air-fuel mixture smoothly flows along the surface of the valve disc 3A without any disturbance. In particular, with the throttle valve 3 fully opened, the air-fuel mixture smoothly flows through the valve disc 3A. In this case, as shown in FIG. 8A, the valve disc 3A may be configured to have a thickness which gradually increases from the both end portions 3*a* which has a smallest thickness and is most distant from the pivot 3B of the valve disc 3A, toward the centre thereof, and the end portions 3*a* are round-shaped. Thereby, with the throttle valve 3 fully opened, the air-fuel mixture flows through the valve disc 3A more smoothly.

As shown in FIG. 7, in the throttle valve 3 with the valve disc 3A being integral with the pivot 3B, the air-intake pipe 2 may be divided in the longitudinal direction into two parts, i.e., upper and lower parts (or right and left parts or other parts) before assembly, and the pivot 3B may be sandwiched between the divided two parts of the air-intake pipe 2.

Figure 9:
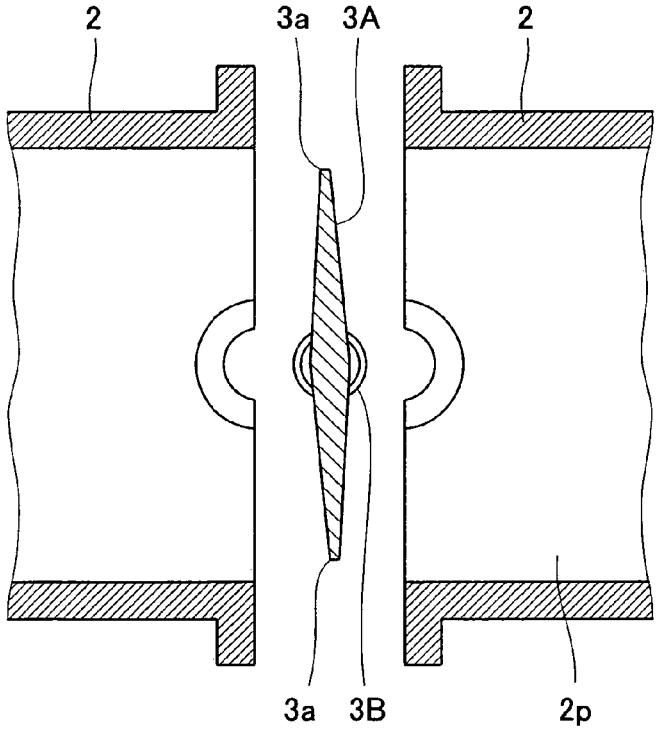
FIG. 9 is a view showing another structure of the air-intake pipe composed of two divided parts, as viewed from a direction perpendicular to the longitudinal direction of the air-intake pipe.

Alternatively, as shown in FIG. 9, the air-intake pipe 2 may be divided into two parts in the direction substantially perpendicular to the longitudinal direction of the air-intake pipe 2 (or in the direction to form a desired angle with respect to the direction). In this case, even the air-intake pipe 2 which is long, has a cross-sectional shape with higher precision because of the absence of a dividing face in the longitudinal direction of the air-intake pipe 2, in contrast to the structure of the air-intake pipe 2 of FIG. 7.

In the throttle valves 3 shown in FIGS. 7 and 9, both ends of the pivot 3B are exposed to outside. Alternatively, at least one of the both ends may be unexposed to outside. This desirably enhances a sealing effect.

Figure 6:
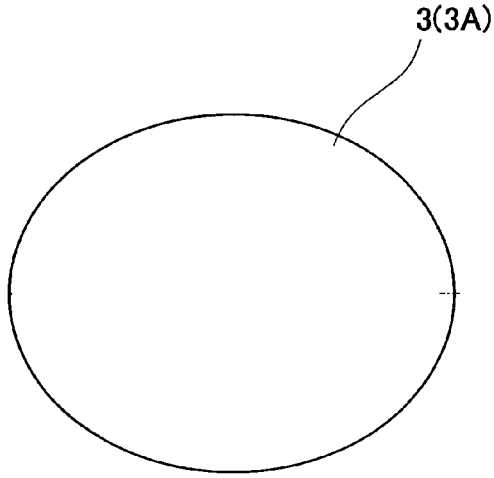
FIG. 6 is a front view showing another shape of the valve disc of the throttle valve of FIG. 5.

In an alternative structure of the throttle valve 3, the valve disc 3A and the air-intake pipe 2 within which the throttle valve 3A is mounted, may be of an oval shape as shown in FIG. 6. In that case, also, the effects of the present invention are obtained, because the fluctuation in the pressure loss can be minimized in the passage from the passage 2*p* of the air-intake pipe 2 to the air-intake passage 1 within the cylinder head 10, in contrast to the passage of the air-intake pipe and the valve disc of substantially a perfect circle shape, which are conventionally known.

Figure 5:
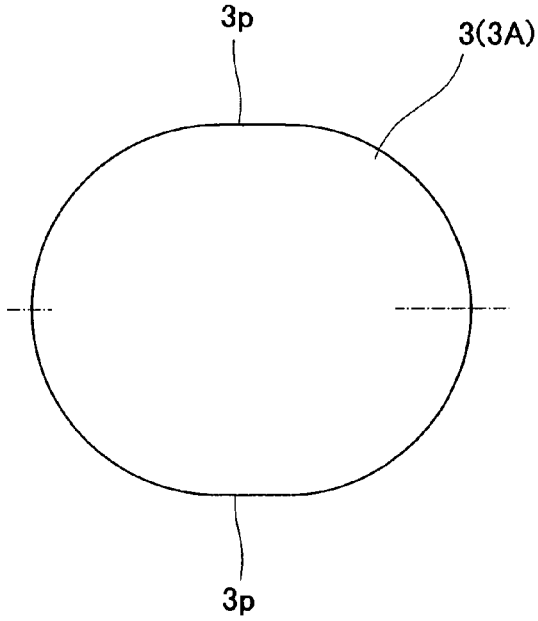
FIG. 5 is a front view showing a shape of the valve disc of the throttle valve of FIGS. 3 and 4.

It will be appreciated that the passage 2*p* of the air-intake pipe 2 and the valve disc 3A of substantially the elongated circle shape shown in FIG. 5 desirably keep a desired spacing between the passage 2*p* of the air-intake pipe 2 and a straight portion 3*p* of an outer periphery of the valve disc 3A, regardless of displacement of the valve disc 3A from the air-intake pipe 2 in the axial direction of the pivot 3B, when the valve disc 3A is mounted into the air-intake pipe 2. In addition, the passage 2*p* of the air-intake pipe 2 and the valve disc 3A of substantially the elongated circle shape can be manufactured with higher yield, because the elongated circle shape is basically formed by straight portion and circular portion.

Figure 10:
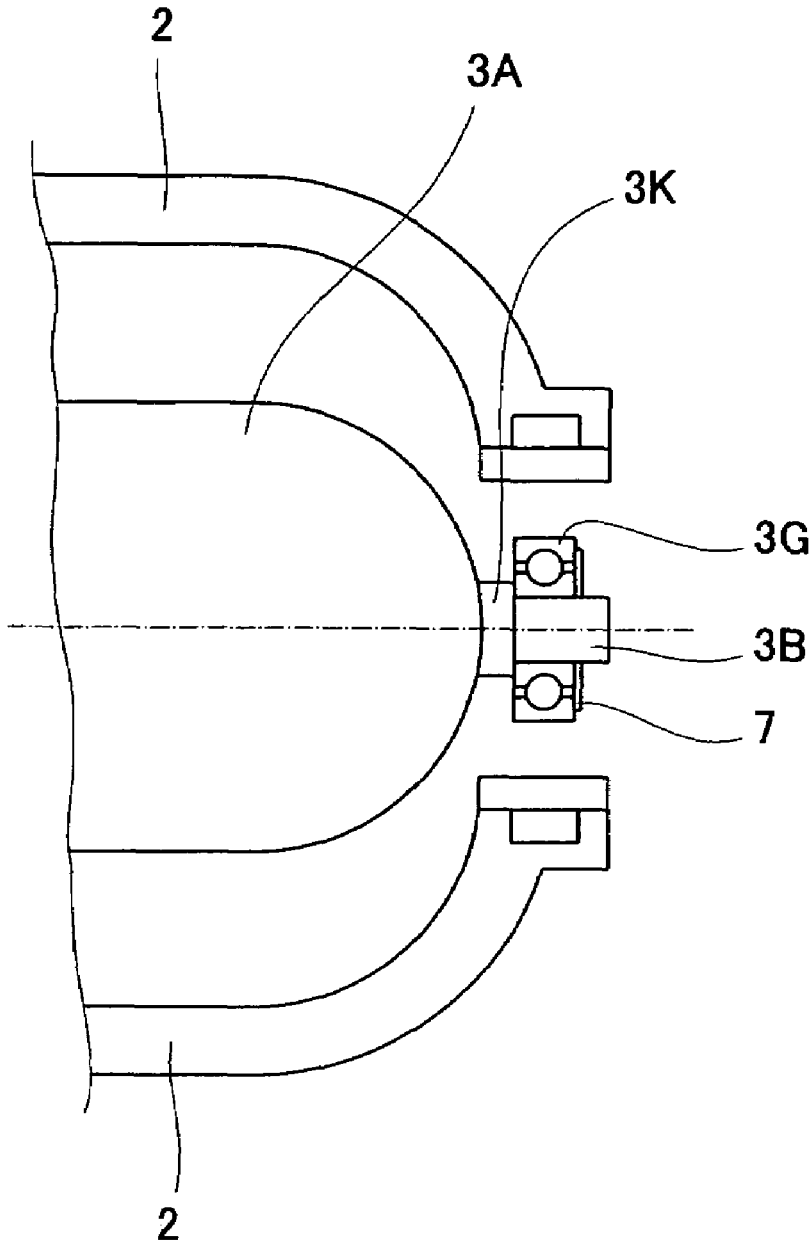
FIG. 10 is a partially enlarged view of a right end portion of a throttle valve, showing another structure of a bearing of the throttle valve of FIG. 7.

As shown in FIG. 10, a flange portion 3K having a diameter larger than a diameter of the pivot 3B may be formed on one side of the pivot 3B which is adjacent to the valve disc 3A and a seal member 7 may be externally fitted to an outer portion of a bearing 3G to enable the throttle valve 3 to be pivotable within the passage 2*p* of the air-intake pipe 2. When this structure is applied to the air-intake pipe 2 composed of divided two parts, the seal member 7 and a labyrinth structure formed by the flange portion 3K desirably provide desired and sufficient sealing effect. The flange portion 3K serves to facilitate positioning of the valve disc 3A and the pivot 3B with respect to the inner wall of the air-intake pipe 2 (or passage 2*p* of the air-intake pipe 2) in such a manner that that the flange portion 3K contacts the bearing 3G and the bearing 3G contacts the air-intake pipe 2.

A dividing face of the divided two parts of the air-intake pipe 2 may be formed at any suitable location of the air-intake pipe 2. Alternatively, the connecting face where the air-intake passage 1 and the air-intake pipe 2 are connected to each other may be the dividing face. This structure is desirably simple.

Figure 11:
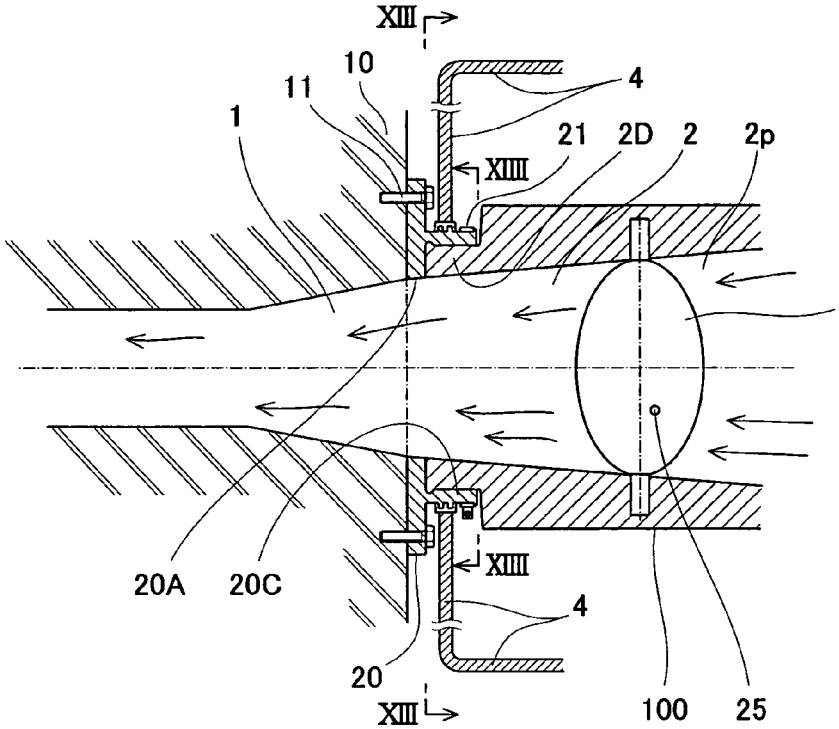
FIG. 11 is a cross-sectional view taken along the longitudinal direction of the air-intake pipe and the air-intake passage connected to the air-intake pipe through an insulator, showing a mounting structure by which the air-intake pipe is mounted to the cylinder head.
Figure 14:
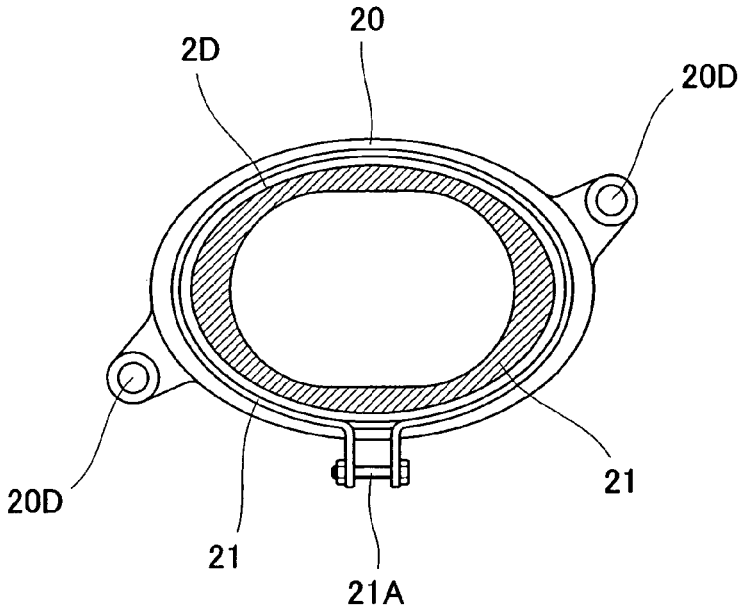
FIG. 14 is a view taken in the direction of arrows substantially along line XIIII-XIIII of FIG. 11, showing a fastening structure (mounting structure) by which the air-intake pipe is connected to the insulator.

It is desirable to connect the air-intake pipe 2 to the air-intake passage 1 through the insulator 20. In that case, as shown in FIG. 14, an entire outer shape of the cross-section of a downstream end portion 2D of the air-intake pipe 2 which is connected to the insulator 20 is oval or a circle (not shown) with a continuously varying positive curvature. This achieves a tightly sealed connection when the air-intake pipe 2 having the passage 2*p* with the shape of FIG. 14 is connected to the air-intake passage 1 (see FIG. 11) within the cylinder head 10, as described later. More specifically, as shown in FIG. 11, the air-intake pipe 2 is mounted to the cylinder head 10 by the insulator 20. With an upstream end portion of the insulator 20 overlapping with the downstream end portion of the air-intake pipe 2 in the longitudinal direction (in this embodiment, the upstream end portion of the insulator 20 overlapping with the downstream end portion of the air-intake pipe 2 in a radial direction), a bolt 21A may be fastened, thereby allowing a fastening force to be uniformly applied to the outer periphery of a band (metal band) 21, as shown in FIG. 14 (or FIG. 11). This achieves a tightly sealed connection between the air-intake pipe 2 and the insulator 20.

Figure 13:
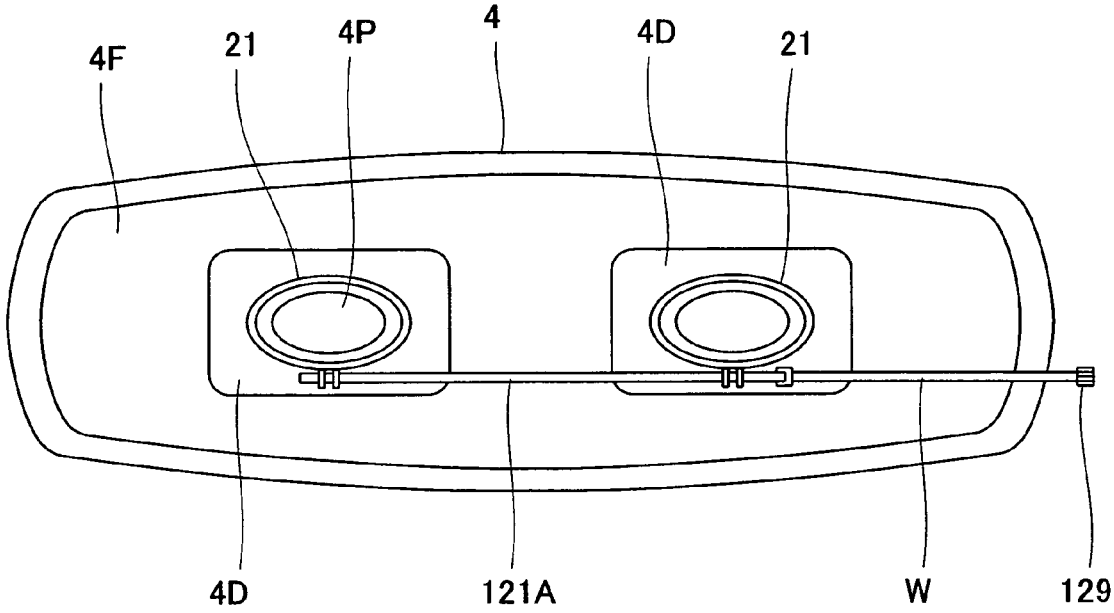
FIG. 13 is a view taken in the direction of arrows substantially along line XIII-XIII of FIG. 11, showing an air-intake box disposed such that one end thereof is positioned at the connecting portion by which the air-intake pipe is connected to the insulator.

As shown in FIG. 13, when two air-intake pipes 2 are arranged within the air-intake box 4, the bands 21 attached to the respective air-intake pipes 2 may be fastened by a single bolt 121A. By rotating an end portion of the bolt 121A, the bands 21 can be entirely fastened. In this case, a wire W may be attached to the end of the bolt 121A and a grip 129 may be attached to one end of the wire w extended to outside of the air-intake box 4. By rotating the grip 129 clockwise or counterclockwise, the bands 21 may be easily fastened or loosened from the direction outside the air-intake box 4.

Figure 12:
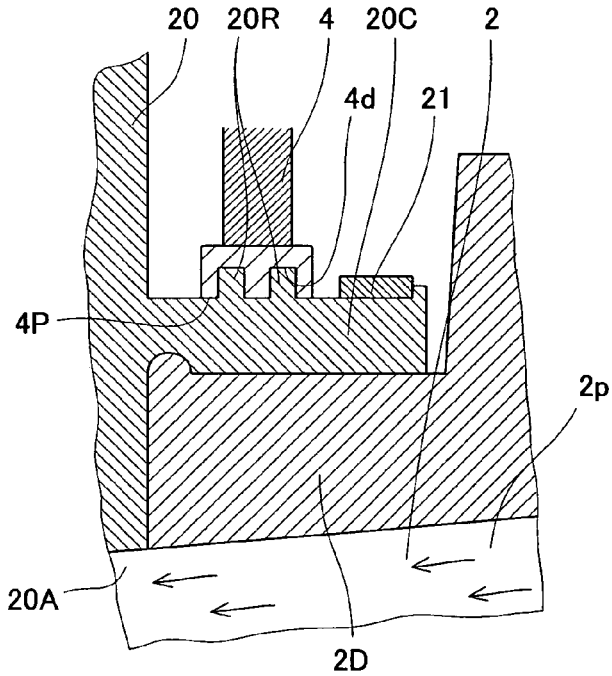
FIG. 12 is an enlarged cross-sectional view of a connecting portion of FIG. 11, by which the air-intake pipe is connected to the insulator.

A connecting structure by which the air-intake pipe 2 is connected to the cylinder head 10 will be described with reference to FIGS. 11 to 14. As shown in FIG. 11, an upstream end of the air-intake passage 1 opens in an end face of the cylinder head 10. The insulator 20 having an inner passage 20A with a cross-sectional shape identical to (or conforming to) that of the opening formed on the end face of the cylinder head 10 is mounted to the cylinder head 10 by bolts 11 inserted through mounting holes 20D and is connected to the opening of the cylinder head 10. As shown in FIG. 12, a tubular portion 20C is formed on an upstream end portion of the insulator 20. The downstream end portion 2D of the air-intake pipe 2 is internally fitted to the tubular portion 20C. The metal band 21 provided with the fastening bolt 21A is fitted to the outer periphery of the insulator 20. Two flange portions 20R are located closer to the cylinder head 10 than the band 21 and is configured to protrude radially outward from the tubular portion 20C. The flange portions 20R are fitted to two grooves 4*d* formed on an opening 4P of the air-intake box 4. In this case, since the insulator 20 is made of rubber, the air-intake box 4 is easily mounted to the insulator 20 in a tightly sealed state.

In this embodiment, the air-intake box 4 contains the two air-intake pipes 2 (see FIG. 11) arranged as shown in FIG. 13. So, two openings 4P are formed on the end face of the air-intake box 4 on the cylinder head 10 side (end face as viewed in the direction of arrows substantially along line XIII-XIII of FIG. 11). Members 4D provided with the openings 4P are made of rubber, and a wall 4F around the members 4D, i.e., a portion other than the members 4D are made of highly rigid plastic.

By positioning one end of the air-intake box 4 at the connecting portion by which the insulator 20 is connected to the air-intake pipe 2, a sufficient volume of the air-intake box 4 is ensured even in a limited space.

As shown in FIG. 11, the valve disc 3A is provided with a hole 25 having a small diameter. Thereby, even during an idle state of the engine E, a small amount of the air-fuel mixture can be supplied to the combustion chamber 15 through the hole 25 in the structure in which the fuel injection nozzle 13 (see FIG. 1) is provided only upstream of the valve disc 3A.

While the fuel injection nozzle 13 is positioned upstream of the air-intake pipe 2 in the embodiment of FIG. 1, it may alternatively be mounted in a mounting hole 2*h* formed on the air-intake pipe 2 to be located downstream of the throttle valve 3, instead of or in addition to the fuel injection nozzle 13 in the embodiment of FIG. 1. More specifically, the mounting hole 2*h* is formed on the air-intake pipe 2 to be located downstream of the throttle valve 3 and is configured to open obliquely such that a longitudinal inner end thereof is positioned on downstream side. The mounting hole 2*h* is tapered to have a diameter which gradually increases toward an inside thereof. An angle T1 of this tapered mounting hole 2*h* is configured to be larger than a spray divergence angle T2 at which the fuel is injected from the fuel injection nozzle 13 to an inside of the passage 2*p* of the air-intake pipe 2 so that the fuel injected from the fuel injection nozzle 13 does not contact a wall of the tapered mounting hole 2*h*.

Figure 15:
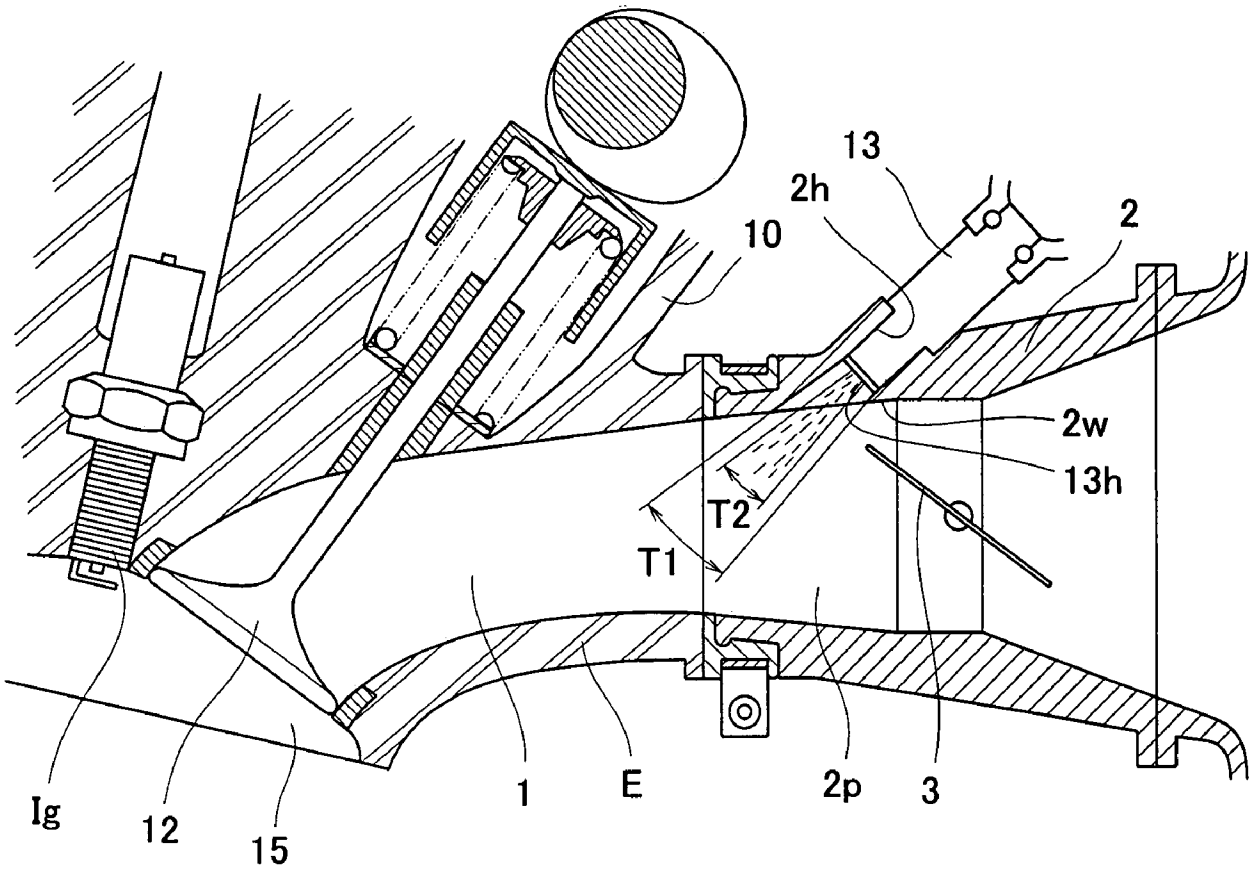
FIG. 15 is a partially cross-sectional view of a structure surrounding a fuel injection nozzle, in which the fuel injection nozzle is mounted to a mounting hole formed on the air-intake pipe.

The fuel injection nozzle 13 is mounted to the mounting hole 2*h* in such a manner that an injection port 13*h* at a tip end of the fuel injection nozzle 13 does not protrude radially inward from an inner wall 2*w* of the air-intake pipe 2, i.e., retreats radially outward from the inner wall 2*w*. In addition, in this embodiment, the fuel injection nozzle 13 is positioned on the short axis of the air-intake pipe 2 (just above the air-intake pipe 2 in FIG. 15). The fuel injection nozzle 13 may alternatively be positioned on the long axis of the air-intake pipe 2. In FIG. 15, E denotes the engine, 1 denotes the air-intake passage of the cylinder head 10, 15 denotes the air-intake valve, 21 denotes the fastening band, and Ig denotes an ignition plug.

While the reciprocal four-cycle engine E has been thus far described in the above embodiments, the present invention is applicable to a two-cycle engine, or a rotary engine as well. In addition, the engine for the leisure vehicle of the present invention may be employed in various leisure vehicles, etc.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An air-intake device of an engine for a leisure vehicle, in which at least two air-intake passages are arranged within a cylinder head of the engine, the air-intake device comprising:

an air-intake pipe having a passage through which fresh air is supplied to the at least two air-intake passages arranged within the cylinder head; and a throttle valve openably mounted within the passage of the air-intake pipe;

wherein the passage of the air-intake pipe has an air-flow cross-section of a non-perfect circle shape in a direction perpendicular to a longitudinal direction of the air-intake pipe, and the non-perfect circle shape is substantially an elongated circle shape having long and short axes or substantially an oval shape having long and short axes;

wherein the throttle valve has a valve disc of a non-perfect circle shape conforming to the shape of the air-flow cross-section of the passage of the air-intake pipe;

wherein an area of the air-flow cross-section of a portion of the air-intake pipe that is located in the vicinity of the air-intake passage of the cylinder head, gradually decreases toward the air-intake passage, and with a first taper angle of an inner wall of the air-intake pipe which is formed when sectioned along the long axis of the air-flow cross-section and with a second a taper angle of the inner wall of the air-intake pipe which is formed when sectioned along the short axis, the first taper angle being configured to be smaller than the second taper angle.

2. The air-intake device according to claim 1, wherein the inner wall of the air-intake pipe with the first and second taper angles is formed from a downstream end of the air-intake pipe in air flow to the valve disc and the inner wall of the air-intake pipe with a third taper angle is formed from the valve disc to an upstream end of the air-intake pipe so as to increase the area of the air-flow cross section from the valve disc toward the upstream end.

3. An air-intake device of an engine for a leisure vehicle, in which at least two air-intake passages are arranged within a cylinder head of the engine, the air-intake device comprising:

an air-intake pipe having a passage through which fresh air is supplied to the at least two air-intake passages arranged within the cylinder head; and a throttle valve having a valve disc and a pivot shaft rotatably supported by the air-intake pipe and openably mounted within the passage of the air-intake pipe;

wherein the passage of the air-intake pipe is configured to have an air-flow cross-section of a non-perfect circle shape in a direction perpendicular to a longitudinal direction of the air-intake pipe; and wherein the valve disc has a non-perfect circle shape conforming to the shape of the air-flow cross-section of the passage of the air-intake pipe, wherein the air-intake pipe within which the throttle valve is mounted is divided into two parts so that a divided surface of the air-intake pipe is located at an axis of the pivot shaft of the throttle valve.

4. An air-intake device according to claim 3 wherein the pivot shaft is formed to extend outward from both ends of the valve disc, the pivot shaft including a pivot portion being rotatably supported by the air-intake pipe via a bearing and a flange portion provided between the valve disc and the pivot portion to contact the bearing.

5. The air-intake device according to claim 3, wherein the air-intake pipe is divided at a position of the axis of the pivot shaft of the throttle valve in a direction perpendicular to the longitudinal direction of the air-intake pipe to form an upstream portion and a downstream portion in air flow.

6. The air-intake device according to claim 3, wherein the air-intake pipe is divided at a position of the axis of the pivot shaft of the throttle valve in a longitudinal direction of the air-intake pipe.

7. The air-intake device according to claim 3, wherein the non-perfect circle shape of the passage of the air-intake pipe is substantially an elongated circle shape having long and short axes or substantially an oval shape having long and short axes; and wherein the area of the air-flow cross-section of a portion of the air-intake pipe that is located in the vicinity of the air-intake passages of the cylinder head, gradually decreases toward the downstream end with a first taper angle of an inner wall of the air-intake pipe which is formed when sectioned along the long axis of the area of the air-flow cross-section and with a second taper angle of an inner wall of the air-intake pipe which is formed along the short axis, the first taper angle being configured to be smaller than the second taper angle.

8. The air-intake device according to claim 7, wherein the inner wall of the air-intake pipe with the first and second taper angles is formed from a downstream end of the air-intake pipe in air flow to the valve disc and the inner wall of the air-intake pine with a third taper angle is formed from the valve disc to an upstream end of the air-intake pipe so as to increase the area of the air-flow cross section from the valve disc toward the upstream end.

9. The air-intake device according to claim 4, wherein the bearing is a ball bearing and wherein a seal member is externally fitted to an outer end portion of the ball bearing.

10. An engine for a leisure vehicle comprising:

an air-intake device in which at least two air-intake passages are arranged within a cylinder head of the engine, including:

an air-intake pipe having a passage through which fresh air is supplied to the at least two air-intake passages arranged within the cylinder head; and a throttle valve openably mounted within passage of the air-intake pipe;

wherein the passage of the air-intake pipe has an air-flow cross-section of a non-perfect circle shape in a direction perpendicular to a longitudinal direction of the air-intake pipe wherein the throttle valve has a valve disc of the non-perfect circle shape conforming to the shape of the air-flow cross-section of the passage of the air-intake pipe; and wherein an area of the air-flow cross section of a portion of the air-intake pipe that is located in the vicinity of the air-intake passage of the cylinder head, gradually decreases toward the air-intake passage with a first taper angle of an inner wall of the air-intake pipe which is formed when sectioned alone the long axis of the air-flow cross-section and with a second taper angle of the inner wall of the air-intake pipe which is formed when sectioned along the short axis, the first taper angle being configured to be smaller than the second taper angle.

11. An engine for a leisure vehicle, comprising:

an air-intake device in which at least two air-intake passages are arranged within a cylinder head of the engine, including:

an air-intake pipe having a passage through which fresh air is supplied to the at least two air-intake passages arranged within the cylinder head; and a throttle valve having a valve disc and a pivot shaft rotatably supported by the air-intake pipe and openably mounted within the passage of the air-intake pipe;

wherein the passage of the air-intake pipe is configured to have an air-flow cross-section of a non-perfect circle shape in a direction perpendicular to a longitudinal direction of the air-intake pipe; and wherein the valve disc has a non-perfect circle shape conforming to the shape of the cross-section of the passage of the air-intake pipe and the air-intake pipe within which the throttle valve is mounted is divided into two parts so that a divided surface of the air-intake pipe is located at an axis of the pivot shaft of the throttle valve.

* * * * *